US009970151B2

(12) United States Patent
Camargo

(10) Patent No.: US 9,970,151 B2
(45) Date of Patent: May 15, 2018

(54) SYSTEM AND METHOD FOR A LAUNDRY WASH BAG

(71) Applicant: Serviam U, LLC, The Woodlands, TX (US)

(72) Inventor: Roberto Trevino Camargo, The Woodlands, TX (US)

( * ) Notice: Subject to any disclaimer, the term of this patent is extended or adjusted under 35 U.S.C. 154(b) by 99 days.

(21) Appl. No.: 15/073,446

(22) Filed: Mar. 17, 2016

(65) Prior Publication Data

US 2017/0268163 A1 Sep. 21, 2017

(51) Int. Cl.

| | |
|---|---|
| ***D06F 95/00*** | (2006.01) |
| ***D06F 35/00*** | (2006.01) |
| ***B65D 85/18*** | (2006.01) |
| ***B65D 33/01*** | (2006.01) |
| ***B65D 33/25*** | (2006.01) |
| ***B65D 30/06*** | (2006.01) |

(52) U.S. Cl.

CPC ..... *D06F 95/006* (2013.01); *B65D 29/04* (2013.01); *B65D 33/01* (2013.01); *B65D 33/2591* (2013.01); *B65D 85/18* (2013.01); *D06F 35/005* (2013.01)

(58) Field of Classification Search

CPC ..... D06F 95/006; D06F 35/005; B65D 29/04; B65D 33/01; B65D 33/2591; B65D 85/18

See application file for complete search history.

(56) References Cited

U.S. PATENT DOCUMENTS

| | | | | |
|---|---|---|---|---|
| 2,064,594 | A * | 12/1936 | Dickey | D06F 95/006 383/103 |
| 2,132,734 | A * | 10/1938 | Hart | D06F 95/006 139/389 |
| 2,225,089 | A * | 12/1940 | Vadnais | D06F 95/006 206/38 |
| 2,235,981 | A * | 3/1941 | Coe et al. | 156/227 |
| 2,373,209 | A * | 4/1945 | Vadnais | D06F 95/006 383/103 |
| 2,439,757 | A * | 4/1948 | Sidnell | D06F 95/006 383/103 |
| 2,442,044 | A * | 5/1948 | Howard | D06F 43/00 24/384 |
| 6,742,683 | B1 * | 6/2004 | Phan | D06F 95/006 223/84 |
| 2007/0014493 | A1 * | 1/2007 | Boyd | D06F 95/006 383/117 |
| 2009/0078725 | A1 * | 3/2009 | Phan | D06F 95/008 223/84 |

(Continued)

*Primary Examiner* — Joseph L. Perrin

(74) *Attorney, Agent, or Firm* — Pramudji Law Group PLLC; Ari Pramudji

(57) ABSTRACT

A system and method for a laundry wash bag can comprise an lattice walls, a solid wall portion and a plurality of nodules. The lattice walls can form a plurality of polygonal perforations. The lattice walls can be capable of containing one or more garments. The solid wall portion can attach on a portion of the lattice walls. The solid wall portion can comprise a fastener that is capable of opening and closing the lattice walls to allow receiving of the one or more garments. The plurality of nodules can be placed within the inner surface of the lattice walls. The plurality of nodules can be capable of rubbing with the one or more garments. The plurality of nodules can be capable of reduce wrinkles during the drying cycle.

15 Claims, 7 Drawing Sheets

(56) References Cited

U.S. PATENT DOCUMENTS

| | | | | |
|---|---|---|---|---|
| 2010/0243686 | A1* | 9/2010 | Zhang | D06F 95/006 223/84 |
| 2013/0051711 | A1* | 2/2013 | Cattan | D06F 95/006 383/105 |
| 2015/0044404 | A1* | 2/2015 | Newland | D06F 5/005 428/35.2 |

* cited by examiner

SYSTEM AND METHOD FOR A LAUNDRY WASH BAG

BACKGROUND

This disclosure relates to a system and method for washing clothes using a laundry wash bag.

For years, laundry wash bag has been used to separate undergarments, and/or clothes of delicate fabrics, when washing clothes through a washing machine and during the drying cycle. Today, the most common laundry wash bag being used is made up of mesh. Laundry mesh bag can be effective in protecting the garments, by preventing the bag contents from rubbing with the outside garments being washed. However, the clothes that rub against each other caused by the agitation of washing machine can cleanse the garments. And since garments inside laundry bag are contained, during the washing cycle the bag contents does not get to rub with the garments outside the bag. Another method that was developed is the use of dryer balls. Such method can be effective in helping during the drying cycle to reduce wrinkles on clothes. However, dryer balls are loose items that can get lost or be misplaced causing inconvenience to the user. As such it would be useful to have an improved system and method for washing or drying clothes using a laundry wash bag.

SUMMARY

A laundry wash bag can comprise lattice walls, a solid wall portion and a plurality of nodules. The lattice walls can comprise a plurality of large perforations, in one embodiment polygonal. The lattice walls can be capable of containing one or more garments. The solid wall portion can attach on a portion of the lattice walls. The solid wall portion can comprise a fastener that is capable of opening and closing the lattice walls to allow receiving of the one or more garments. The plurality of nodules can be placed within the inner surface of the lattice walls. The plurality of nodules can be capable of rubbing with the one or more garments. The plurality of nodules can be capable of reducing wrinkles during the drying cycle.

This disclosure also relates to a method for a laundry wash bag. The method can comprise the steps of receiving of one or more garments within the laundry wash bag. The laundry wash bag can comprise an lattice walls, a solid wall portion and a plurality of nodules. The lattice walls can form a plurality of polygonal perforations. The lattice walls can be capable of containing one or more garments. The solid wall portion can attach on a portion of the lattice walls. The solid wall portion can comprise a fastener that is capable of opening and closing the lattice walls to allow receiving of the one or more garments. The plurality of nodules can be placed within the inner surface of the lattice walls. The plurality of nodules can be capable of rubbing with the one or more garments. Furthermore, the method can also comprise the steps of placing the laundry wash bag into a washing machine, and rubbing of the plurality of nodules with the one or more garments during washing cycle. The plurality of nodules can be capable of reducing wrinkles during the drying cycle.

DETAILED DESCRIPTION

Described herein is a system and method for washing or drying clothes using a laundry wash bag. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
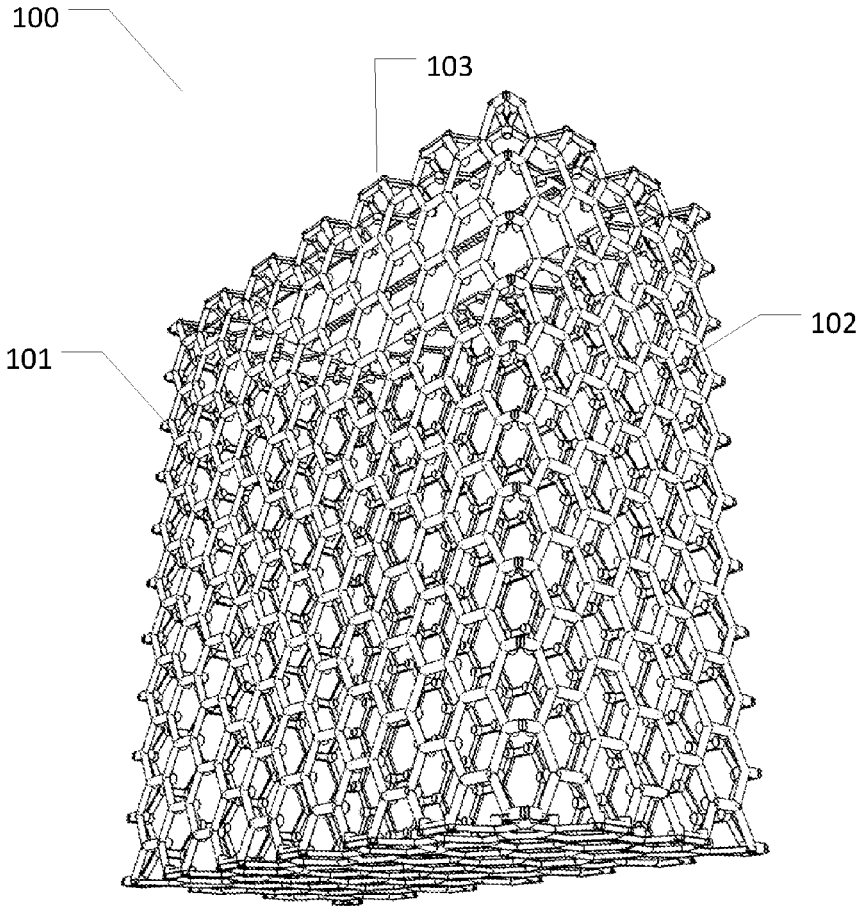
FIG. 1 illustrates a laundry wash bag.

FIG. 1 illustrates a laundry wash bag 100. Laundry wash bag 100 can be formed from a durable lattice walls 101, which can include but is not limited to silicone. Laundry wash bag 100 can act as a barrier and can be capable of containing one or more garments. Laundry wash bag 100 can be in various shapes, such as rectangular, cylindrical, and spherical. Moreover, laundry wash bag 100 can be in different size and dimension. As an example embodiment, a large bag can be 56 cm in diameter, a medium sized bag can have a diameter of 46 cm, and a small bag can have a diameter of 36 cm. In such embodiment, the large bag can be used for colored garments, the medium sized bag can be used for dark garments, and the small bag can be used to hold white garments or delicate garments when needed. Further, lattice walls 101 can form a plurality of polygonal perforations 102. Each perforation 102 can permit water, and/or cleaning agents, such as fabric softener, and laundry detergent to go through laundry bag 100. Furthermore, laundry wash bag can comprise a solid wall portion 103. Solid wall portion 103 can be a flat unperforated surface attached within one or more lattice walls 101.

Figure 2:
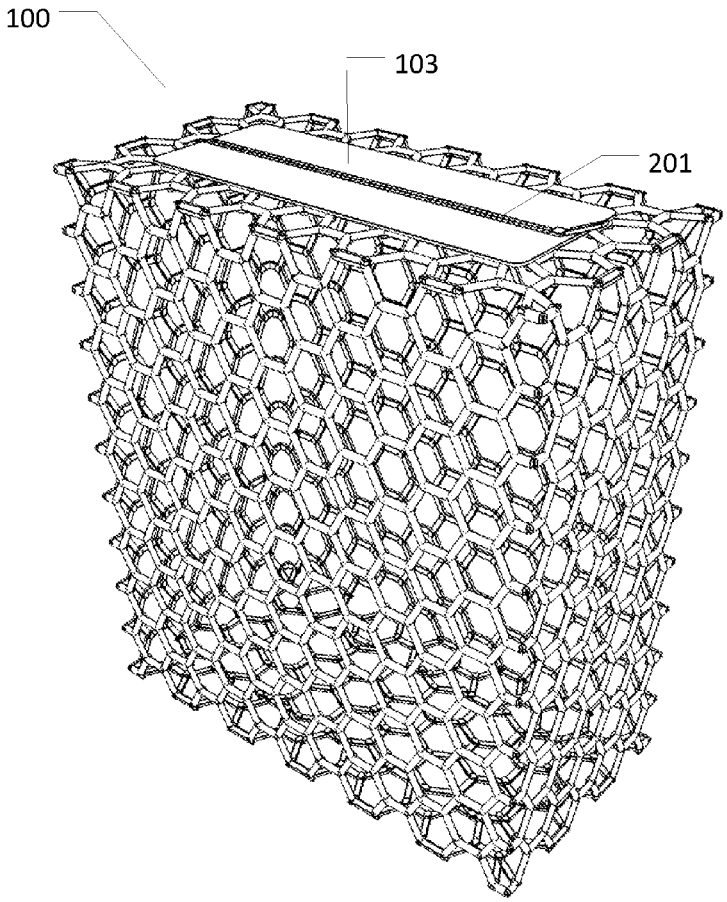
FIG. 2 illustrates a top view of a laundry wash bag comprising a solid wall portion.

FIG. 2 illustrates a top view of laundry wash bag 100 comprising solid wall portion 103. Solid wall portion 103 can comprise a fastener 201. Fastener 201 can be any durable and waterproof fastening device that can include but is not limited to zipper, snaps, and/or clasps. In a preferred embodiment, fastener 201 can be a waterproof zipper. In such embodiment, garments within laundry wash bag 100 can be securely contained. Furthermore, such type of fastener minimizes the chance of getting snagged and/or tangled with clothes that are outside laundry wash bag 100. Fastener 201 can be positioned at the center of solid wall portion 103.

Figure 3:
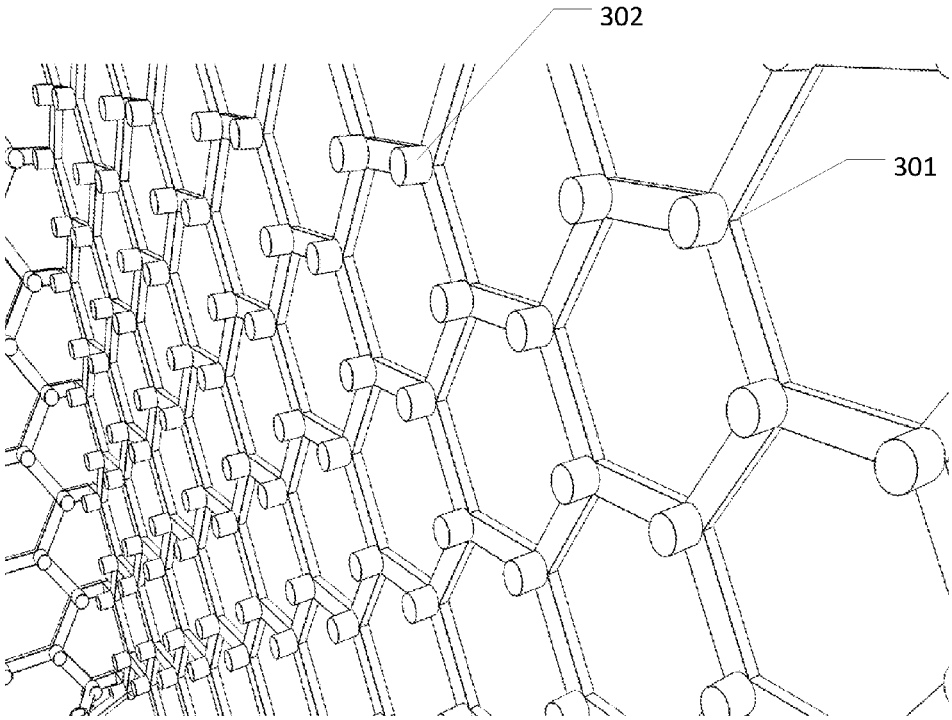
FIG. 3 illustrates an expanded view of the inner surface of a laundry wash bag.

FIG. 3 illustrates an expanded view of the inner surface of laundry wash bag 100. In one embodiment, each of said polygonal perforations 102 can be hexagonal in shape. As such, lattice walls 101 can form a plurality of vertex 301. Further, the inner surface of laundry wash bag 100 can comprise a plurality of nodules 302. Each nodule 302 can be placed on each vertex 301 such that each nodule 302 can protrude from the inner surface of lattice walls 101. Materials used for nodules 302 can be the same with lattice walls 101. In one embodiment, the tip of each nodule 302 can be flat. In another embodiment, the tip of each nodule 302 can be rounded.

Figure 4:
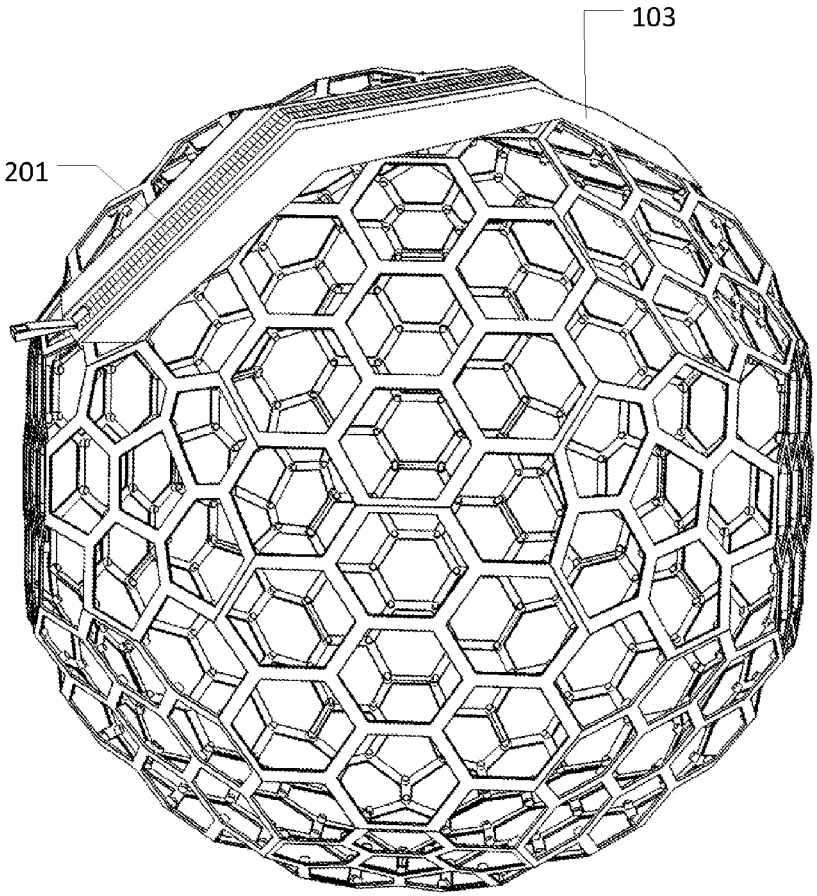
FIG. 4 illustrates an embodiment of a laundry wash bag with a spherical structure.

FIG. 4 illustrates an embodiment of laundry wash bag 100 with a spherical structure.

Figure 5:
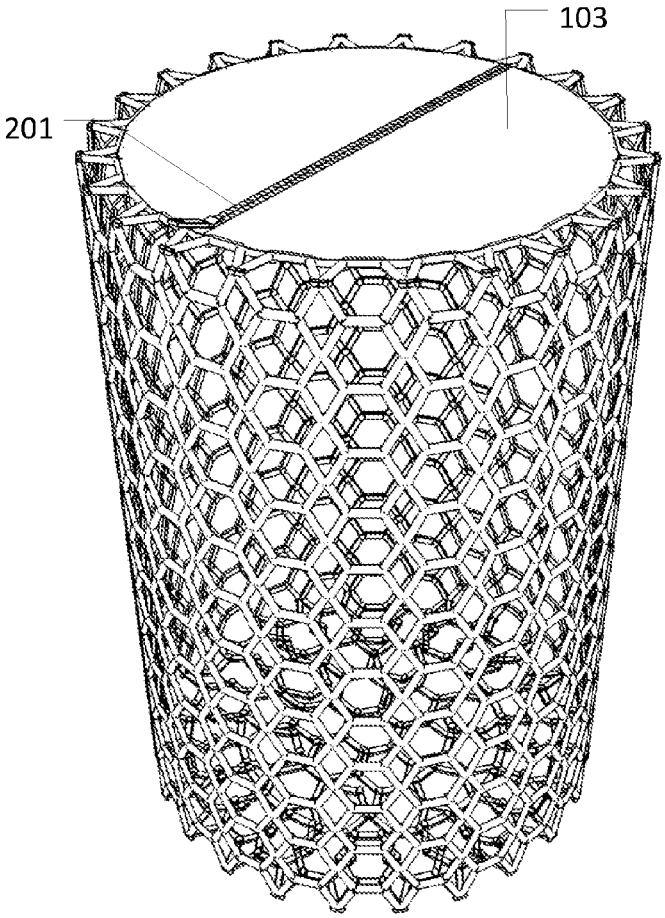
FIG. 5 illustrates an embodiment of laundry a wash bag with a cylindrical structure.

FIG. 5 illustrates an embodiment of laundry wash bag 100 with a cylindrical structure.

Figure 6:
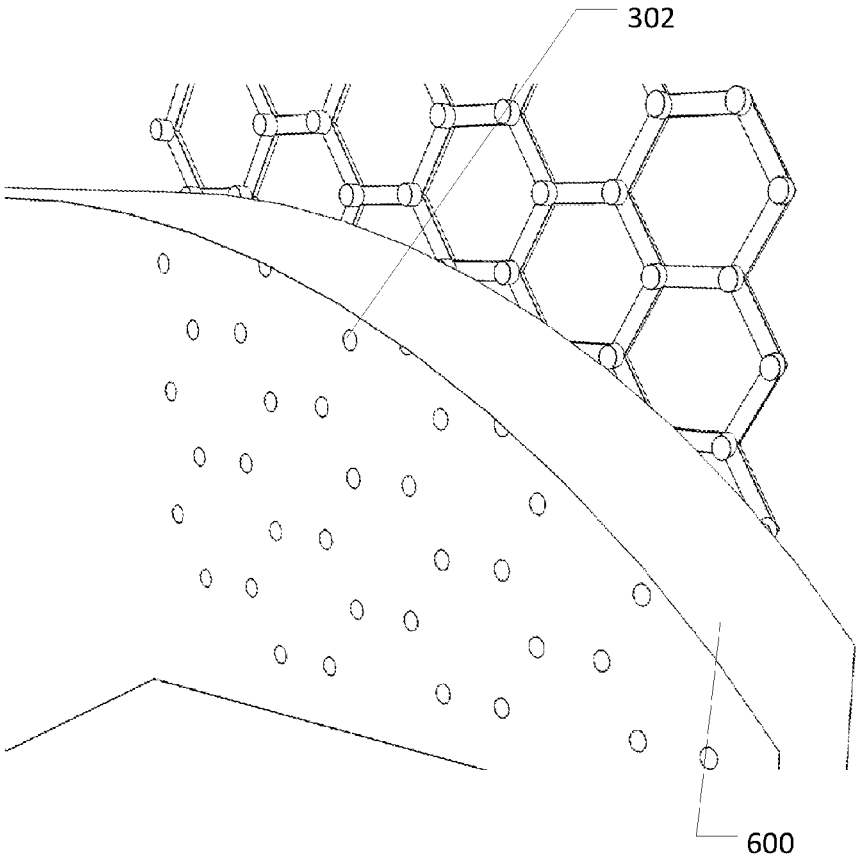
FIG. 6 illustrates how a plurality of nodules can aid in washing the garments within a laundry wash bag.

FIG. 6 illustrates how nodules 302 can aid in washing the garments within laundry wash bag 100. Initially, laundry wash bag 100 can be contained with one or more garments 600, laundry wash bag 100 can be placed within a washing machine. During the washing cycle, nodules 302 can rub against the garments placed within laundry wash bag 100 thus, the rubbing action of the nodules 302 can simulate the massaging action of hand washing. Such feature can provide an efficient washing of garments within laundry wash bag 100.

Figure 7:
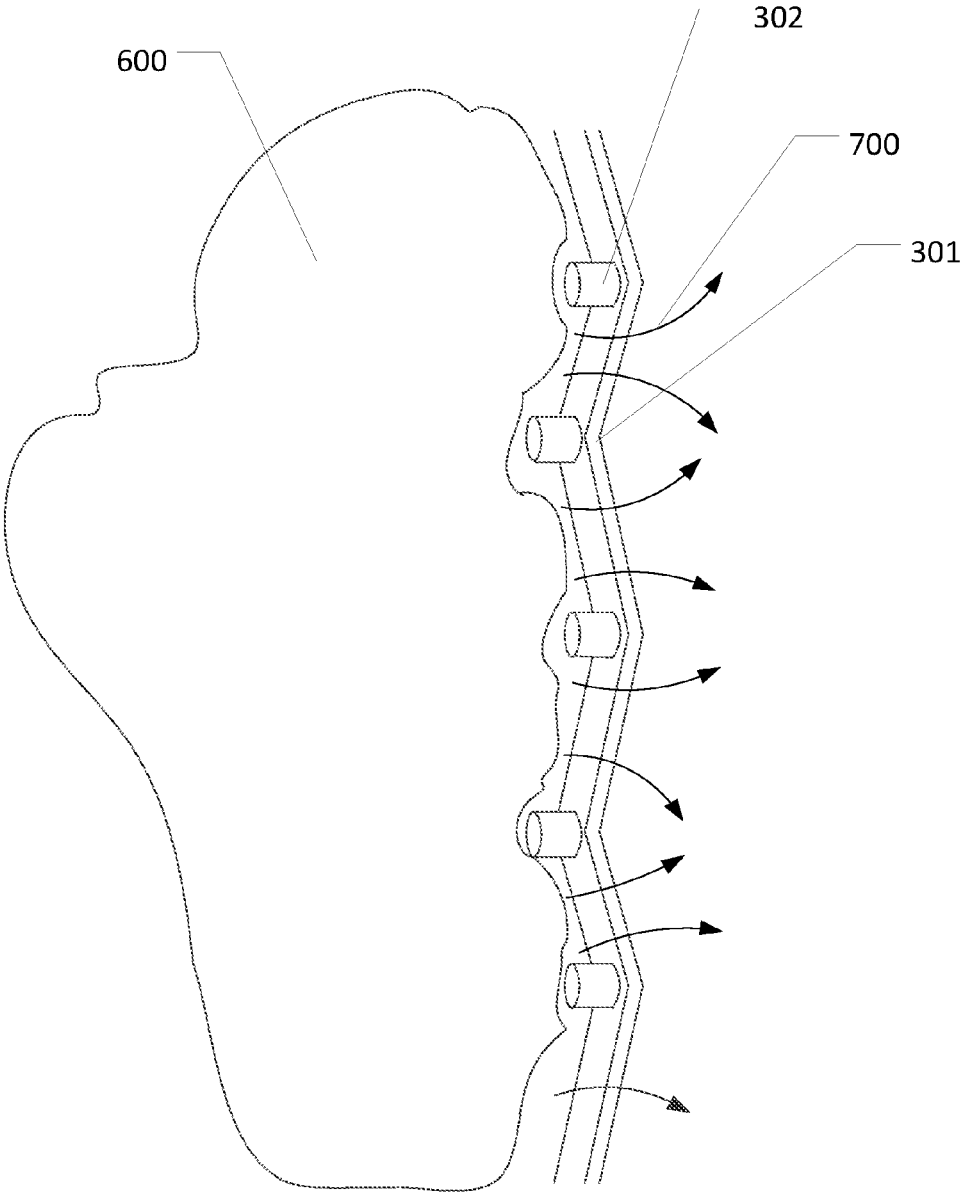
FIG. 7 illustrates how a plurality of nodules can aid in minimizing wrinkles on the garments while drying.

FIG. 7 illustrates how nodules 302 can aid in minimizing wrinkles on the garments while drying. During the drying cycle, nodules 302 that protrude from the inner surface of lattice walls 101 can push the garments within laundry wash bag 100. As such, air 700 can circulate better and prevent garments from clinging with other clothes thus minimizing clothes from wrinkling.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A laundry wash bag, comprising:

one or more lattice walls capable of containing one or more garments, the one or more lattice walls comprising:

a plurality of polygonal perforations, each polygonal perforation having a plurality of vertices; and a plurality of nodules on an inner surface of said lattice walls, the plurality of nodules being:

placed at each vertex of the plurality of polygonal perforations; and capable of rubbing with said one or more garments; and a solid wall portion attached to said one or more lattice walls, said solid wall portion comprising a fastener that is capable of opening and closing said lattice walls to allow receiving of said one or more garments.

2. The laundry wash bag of claim 1 wherein each polygonal perforation is hexagonal in shape such that said lattice walls form the plurality of vertices.

3. The laundry wash bag of claim 1 wherein said fastener is a waterproof zipper.

4. The laundry wash bag of claim 1 wherein said lattice walls comprise silicone.

5. The laundry wash bag of claim 1 wherein said lattice walls comprise a spherical structure.

6. The laundry wash bag of claim 1 wherein said lattice walls comprise a rectangular structure.

7. The laundry wash bag of claim 1 wherein said lattice walls comprise a cylindrical structure.

8. A method for washing clothes using a laundry wash bag, comprising:

receiving one or more garments within said laundry wash bag, wherein said laundry wash bag comprises one or more lattice walls capable of containing the one or more garments, the one or more lattice walls comprising:

a plurality of polygonal perforations, each polygonal perforation having a plurality of vertices; and a plurality of nodules on an inner surface of the lattice walls, the plurality of nodules being:

placed at each vertex of the plurality of polygonal perforations; and capable of rubbing with said one or more garments;

a solid wall portion attached to a portion of said lattice walls, said solid wall portion comprising a fastener that is capable of opening and closing said lattice walls to allow receiving of said one or more garments; and rubbing of said nodules with said one or more garments during a washing cycle.

9. The method of claim 8 further comprising the step of pushing said one or more garments away from lattice walls through said nodules during a drying cycle such that air can circulate between said lattice walls and said one or more garments.

10. The method of claim 8 wherein each of said polygonal perforation is hexagonal in shape such that said lattice walls forms the plurality of vertices.

11. The method of claim 8 wherein said fastener is a waterproof zipper.

12. The method of claim 8 wherein said lattice walls comprise silicone.

13. The method of claim 8 wherein said lattice walls comprise a spherical structure.

14. The method of claim 8 wherein said lattice walls comprise a rectangular structure.

15. The method of claim 8 wherein said lattice walls comprise a cylindrical structure.

* * * * *